US010180147B2

(12) United States Patent
Borkowski

(10) Patent No.: US 10,180,147 B2
(45) Date of Patent: Jan. 15, 2019

(54) COMPRESSOR SYSTEM WITH FLOAT DRAIN

(71) Applicant: Ingersoll-Rand Company, Davidson, NC (US)

(72) Inventor: Michael R. Borkowski, Concord, NC (US)

(73) Assignee: Ingersoll-Rand Company, Davidson, NC (US)

( * ) Notice: Subject to any disclaimer, the term of this patent is extended or adjusted under 35 U.S.C. 154(b) by 444 days.

(21) Appl. No.: 14/967,498

(22) Filed: Dec. 14, 2015

(65) Prior Publication Data

US 2016/0186781 A1 Jun. 30, 2016

Related U.S. Application Data

(60) Provisional application No. 62/098,618, filed on Dec. 31, 2014.

(51) Int. Cl.
*F04D 29/70* (2006.01)
*F04D 17/12* (2006.01)
*F04D 29/58* (2006.01)

(52) U.S. Cl.
CPC ..... *F04D 29/706* (2013.01); *F04D 17/12* (2013.01); *F04D 29/5826* (2013.01); *F05D 2260/602* (2013.01)

(58) Field of Classification Search
CPC .... F04D 29/706; F04D 29/5826; F04D 17/12; F04D 29/705; F16K 15/021; F16K 15/025; F16K 15/026; F16K 15/04; F16K 15/044; F16K 15/06; F16K 24/042; F16T 1/22; F05D 2260/602; Y10T 137/7842; Y10T 137/88054
USPC ..... 137/512, 512.3, 613, 614.2
See application file for complete search history.

(56) References Cited

U.S. PATENT DOCUMENTS

| | | | | |
|---|---|---|---|---|
| 1,316,171 | A * | 9/1919 | Marion | F16T 1/24 137/192 |
| 2,508,132 | A | 5/1950 | Aikman | |
| 4,562,855 | A | 1/1986 | Cummings et al. | |
| 4,685,486 | A | 8/1987 | Yokoyama | |
| 4,856,550 | A | 8/1989 | Smelcer | |
| 4,917,795 | A * | 4/1990 | Sable | B01D 36/001 137/202 |
| 2007/0095097 | A1* | 5/2007 | Cowans | F25B 41/00 62/512 |
| 2007/0107425 | A1 | 5/2007 | Appleton | |

FOREIGN PATENT DOCUMENTS

WO 2007075015 A2 7/2007

* cited by examiner

*Primary Examiner* — Eldon Brockman
(74) *Attorney, Agent, or Firm* — Taft Stettinius & Hollister LLP

(57) ABSTRACT

A compressor system having at least one fluid compressor for compressing a working fluid is disclosed herein. The compressor system can include at least one heat exchanger for removing heat from compressed working fluid. At least one moisture separator can be coupled to the compressor system to separate condensed liquid from the compressed working fluid. A float drain module can be positioned within the moisture separator for receiving the condensed liquid. A float valve and a check valve housed within the float drain module are movable between open and closed positions and cooperate to remove condensed liquid from the working fluid without permitting discharge of gaseous working fluid.

25 Claims, 4 Drawing Sheets

COMPRESSOR SYSTEM WITH FLOAT DRAIN

CROSS REFERENCE TO RELATED APPLICATIONS

This application claims the benefit of U.S. Provisional Application No. 62/098,618, filed Dec. 31, 2014, which is incorporated herein by reference in its entirety.

TECHNICAL FIELD

The present application generally relates to industrial air compressor systems and more particularly, but not exclusively, to a compressor system having a high efficiency float drain with an integrated check valve.

BACKGROUND

Industrial compressor systems are configured to produce large volumes of pressurized fluid such as air or the like. The process of compressing the fluid necessarily causes heat addition to the fluid. A heat exchange cooler can be used to cool the hot compressed fluid to a predefined temperature after exiting a compressor stage. When the fluid is cooled, water vapor content in the fluid can condense if the temperature is reduced below the vapor pressure point. Condensed water can degrade the compressor system though corrosion and/or erosion if not removed from the system, however in some systems, removal of condensed water from the pressurized fluid can lead to loss of some of the pressurized fluid and thus reduces the efficiency of the compressor system. Some existing systems have various shortcomings relative to certain applications. Accordingly, there remains a need for further contributions in this area of technology.

SUMMARY

One embodiment of the present application is a unique compressor system with a high efficiency float drain. Other embodiments include apparatuses, systems, devices, hardware, methods, and combinations for compressor systems with a unique float drain for a liquid separator system. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
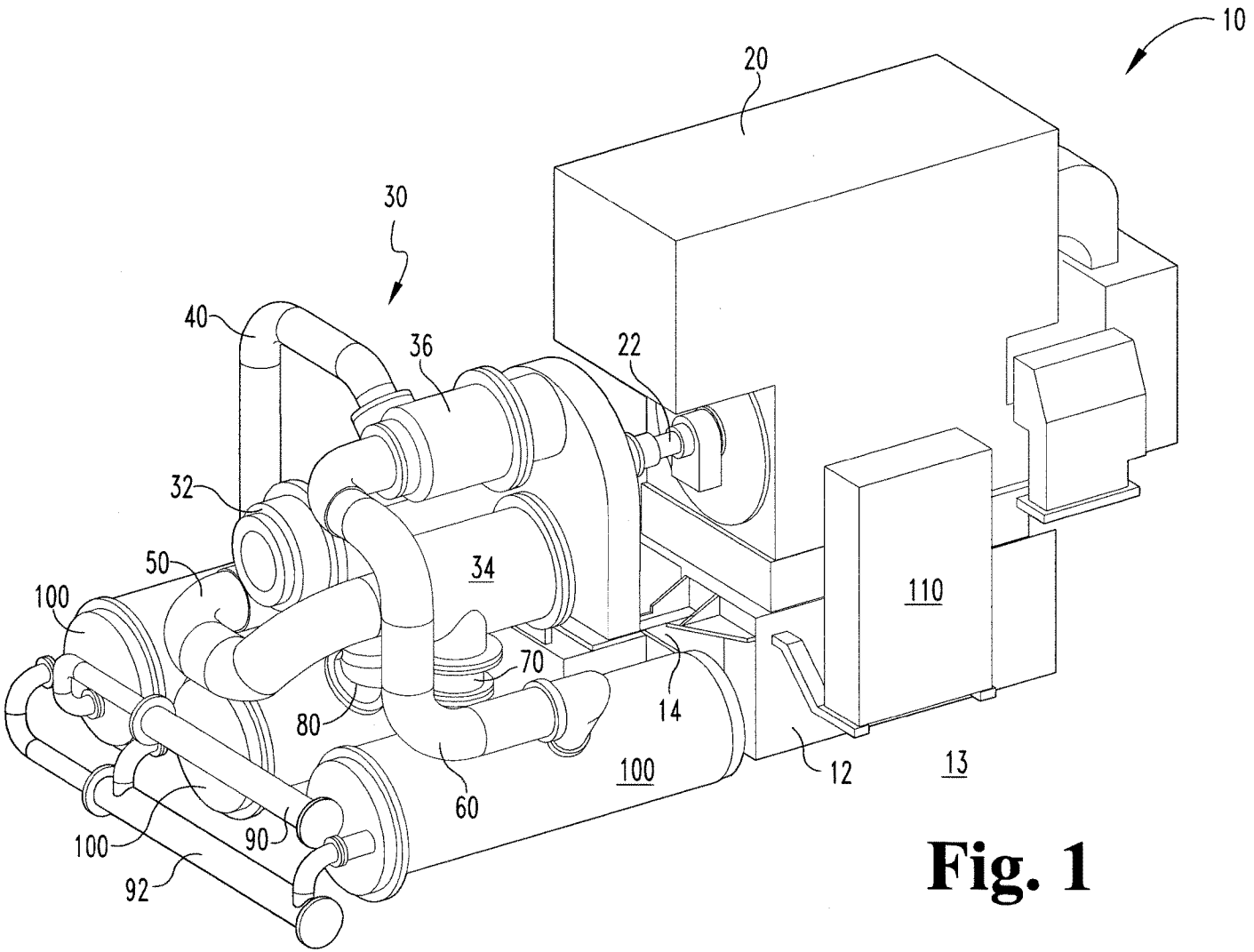
FIG. 1 is a perspective view of a compressor system according to one embodiment of the present disclosure.

For the purposes of promoting an understanding of the principles of the application, reference will now be made to the embodiments illustrated in the drawings and specific language will be used to describe the same. It will nevertheless be understood that no limitation of the scope of the application is thereby intended. Any alterations and further modifications in the described embodiments, and any further applications of the principles of the application as described herein are contemplated as would normally occur to one skilled in the art to which the application relates.

Industrial compressor systems that use fluid to fluid heat exchangers such as intercoolers can produce unwanted liquid condensation such as water from a working fluid. The term "fluid" should be understood to include any gas or liquid medium used in the compressor system as disclosed herein. Heat exchangers such as intercoolers or the like can be of any type commonly utilized in industrial applications. When high pressure and high temperature gas is cooled in a heat exchanger, water vapor content or other contaminant fluids can condense into liquid form. Liquid water can cause degradation in components of the compressor system through corrosion and erosion over time, therefore water separation and removal can be desirable in certain applications. Separating and removing the liquid water from the high pressure working fluid in gaseous form is difficult to do without losing a portion of the compressed gaseous fluid that may become entrained with the condensed water. Any loss of compressed working fluid during water separation and removal translates into efficiency losses in the compressor system and thus drives up costs of operation. The present disclosure provides an apparatus and method for removing liquids including water or the like from the compressor system while limiting or completely eliminating loss of the compressed working gaseous fluid.

Referring now to FIG. 1, an exemplary compressor system 10 is shown therein. The compressor system 10 includes a primary motive source 20 such as an electric motor, an internal combustion engine or a fluid-driven turbine and the like. The compressor system 10 can include a compressor 30 with multi-stage compression and in the exemplary embodiment includes a first stage compressor 32, a second stage compressor 34, and a third stage compressor 36. In other embodiments a different number of compressor stages may be employed with the compressor 30. The compressor 30 can include centrifugal, axial and/or positive displacement compression means. The primary motive source 20 is operable for driving the compressor 30 via a drive shaft 22 to compress fluids such as air, natural gas, propane or the like.

A structural base 12 is configured to support at least portions of the compressor system 10 on a support surface 13 such as a floor or ground and the like. One or more cantilevered extensions or arms 14 can extend from the base 12 and can be configured to hold portions of the compressor system 10 suspended above the support surface 13. Portions of the compressed air discharged from the compressor 30 can be transported through more one or more conduits 40, 50, 60, 70 and 80 to one or more intercoolers 100 and/or to another compressor stage. An inlet fluid manifold 90 and an outlet fluid manifold 92 can be fluidly connected to the intercoolers 100 to provide cooling fluid such as water or other liquid coolant to cool the compressed air after discharge from one or more of the compressor stages of the compressor 30. The compressor system 10 can also include a controller 110 operable for controlling the primary motive power source and various valving and fluid control mechanisms (not shown) between the compressor 30 and intercoolers 100. The compressor system of FIG. 1 is one exemplary form of compressor systems that can be used with the teachings of the present disclosure. Other forms and configurations are contemplated herein.

Figure 2:
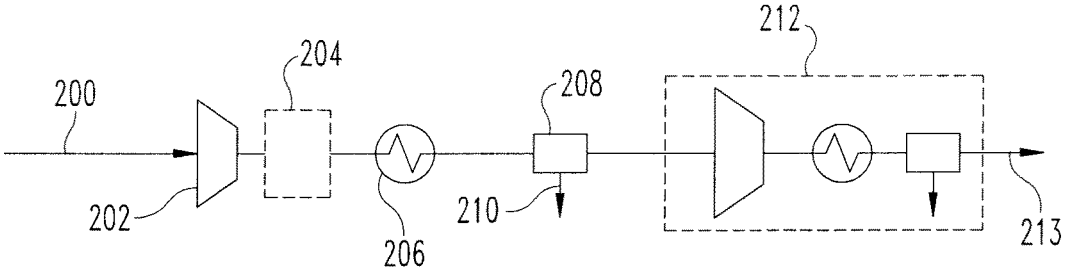
FIG. 2 is a schematic view of a portion of the compressor system illustrated in FIG. 1.

Referring now to FIG. 2, a portion of the compressor system 10 is illustrated in schematic form. A working fluid illustrated by arrow 200 can be delivered to a first compressor stage 202 for compressing the working fluid 200 to a desired pressure. The working fluid 200 can include various constituencies including air, water, oil, or other desirable constituents and/or undesirable contaminants. The compressor system 10 can include an optional air/oil separator illustrated by the dashed rectangle 204 for some compressor system applications. The compressed working fluid 200 then enters a first stage heat exchanger 206 to reduce the temperature of the working fluid 200 to a desired level. Upon cooling the working fluid 200 some of the fluid constituents can be readily condensed into a liquid in a moisture separator 208. The moisture separator 208 is operable for separating liquids from gaseous fluids and draining the liquids through a drain 210 as will be described in more detail below. The compressor system 10 can include optional additional stages of the system 212 that can repeat one or more of the operations described previously such that a final working fluid pressure and temperature can be delivered to a working load 213 for use as is known in operational application.

Figure 3:
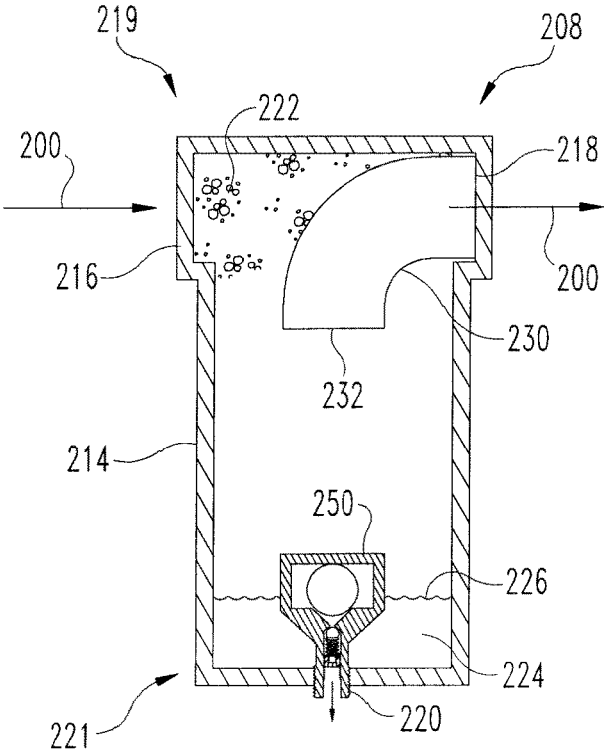
FIG. 3 is a cross sectional view of a moisture separator according to one embodiment of the present disclosure.

Referring now to FIG. 3, a moisture separator 208 is illustrated in schematic form. The moisture separator 208 can include a housing 214 for receiving the working fluid 200 through a working fluid inlet 216 and expelling the working fluid 200 through a working fluid outlet 218 positioned towards a upper region 219 of the moisture separator 208. The housing 214 of the moisture separator 208 includes a condensed liquid outlet 220 proximate a lower region 221 of the housing 214. The terms "upper region" and "lower region" are relative to gravitational potential and need not be directly in line with one another or free from intervening components, pathways, or other structure. When the working fluid 200 enters through the working fluid inlet 216 of the housing 214 after being cooled through the first stage heat exchanger 206 (see FIG. 2), the fluid can have portions that are cooled to a saturated air temperature illustrated by liquid bubbles 222 proximate the upper region 219 of the housing 214. Condensed liquid 224 then falls towards the lower region 221 of the housing 214 through gravitational force. The condensed liquid 224 has a liquid surface 226 that defines the height of the condensed liquid in the housing 214. The remainder of the working fluid 200 can enter a working fluid port 230 through a port inlet 232 and can exit through the working fluid outlet 218 after at least a portion of the liquid particles are removed therefrom. The condensed liquid 224 can include water, oil, or other non-gaseous fluids. A float drain module 250 is positioned proximate the lower region 221 of the housing 214 and is in operable communication with the condensed liquid outlet 220 of the housing 214 and will be described in more detail below.

Figure 4:
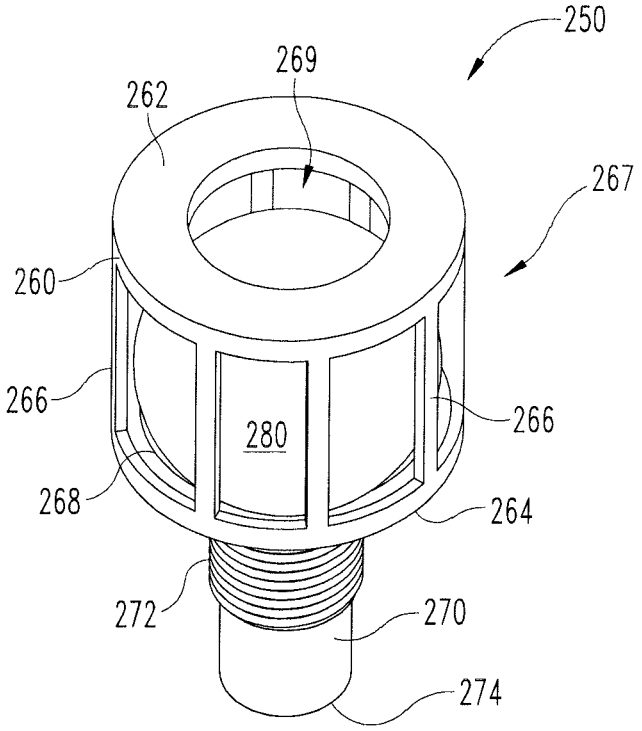
FIG. 4 is a perspective view of a float drain module according to one embodiment of the present application.

Referring now to FIG. 4, the float drain module 250 is illustrated in a perspective view in one embodiment of the present disclosure. The float drain module 250 can include a float drain housing 260 that is defined by an upper rim 262 and a lower rim 264 spaced apart by a plurality of support beams 266 intermittently positioned around a perimeter 267 of the float drain housing 260. In one embodiment the perimeter 267 can be substantially round or circular in form, however, in other embodiments it should be understood that other configurations can be utilized and are contemplated herein. A plurality of intermittent open spaces 268 are formed as liquid inlet windows between the plurality of support beams 266. The open spaces 268 can be generally rectangular in shape as shown or alternatively be formed in other geometric configurations such as square, circular or regularly and irregularly shaped configurations. The upper rim 262 can include a through aperture 269 to permit condensed liquid to enter the float drain housing 260 from above the housing 260. The condensed liquid, not shown in this figure, can enter the float drain housing 260 through any of the open spaces 268 and/or through aperture 269 formed in the upper rim 262.

A drain conduit 270 can extend from the lower rim 264 of the float drain housing 260 and in one form can mechanically engage with the moisture separator housing 214 through threaded engagement via threads 272 or the like. Other housing connector means as known to those skilled in the art are also contemplated herein. A drain outlet 274 is positioned at a distal end of the drain conduit 270 for releasing the condensed liquid from the moisture separator housing 208 (shown in FIG. 3).

A float valve 280 can be operably positioned within the perimeter 267 of the float drain housing 260 and is movable between the upper and lower rims 262, 264 respectively. The float valve 280 in one illustrative configuration can be a spherically shaped structure such as a ball or the like. In alternate embodiments the float valve 280 can be shaped with other desirable configurations such as, by way of example and not limitation, a cone shape, a rod shape, or other functional valve configurations.

Figure 5:
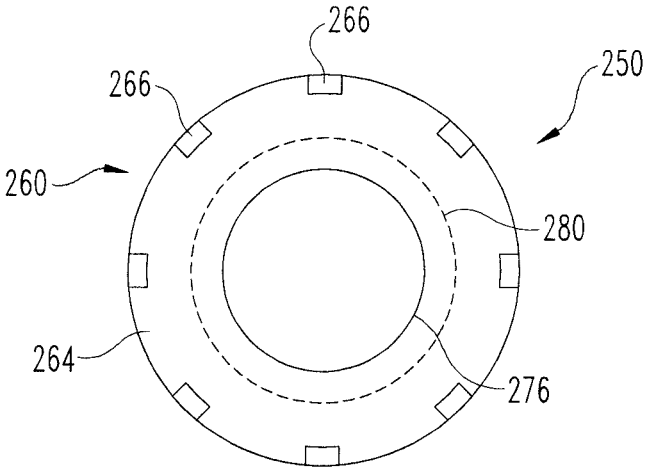
FIG. 5 is a top view partially cut away of the float drain module of FIG. 4.

Referring now to FIG. 5, a top view of the float drain module 250 is shown with portions partially removed. The upper rim 262 is removed for clarity to show various features of the float drain module 250. The support beams 266 are shown as being rectangular in cross section however, it should be understood that other shapes or configurations are contemplated herein. The support beams 266 are intermittently placed around the perimeter of the lower rim 264 to provide structural support for the float drain housing 260. A drain conduit passageway 276 is configured to have a smaller diameter than a portion of the float valve 280 illustrated as a dash circle. The float drain conduit passageway 276 permits condensed liquid 224 (see FIG. 3) to be released from the moisture separator housing 214 through the drain outlet 274 (shown in FIG. 4) when the liquid surface 226 reaches a pre-determined level within the float drain housing 260 and thus causing the float valve 280 to raise under a buoyancy force and permit liquid to move toward the drain conduit passageway 276.

Figure 6:
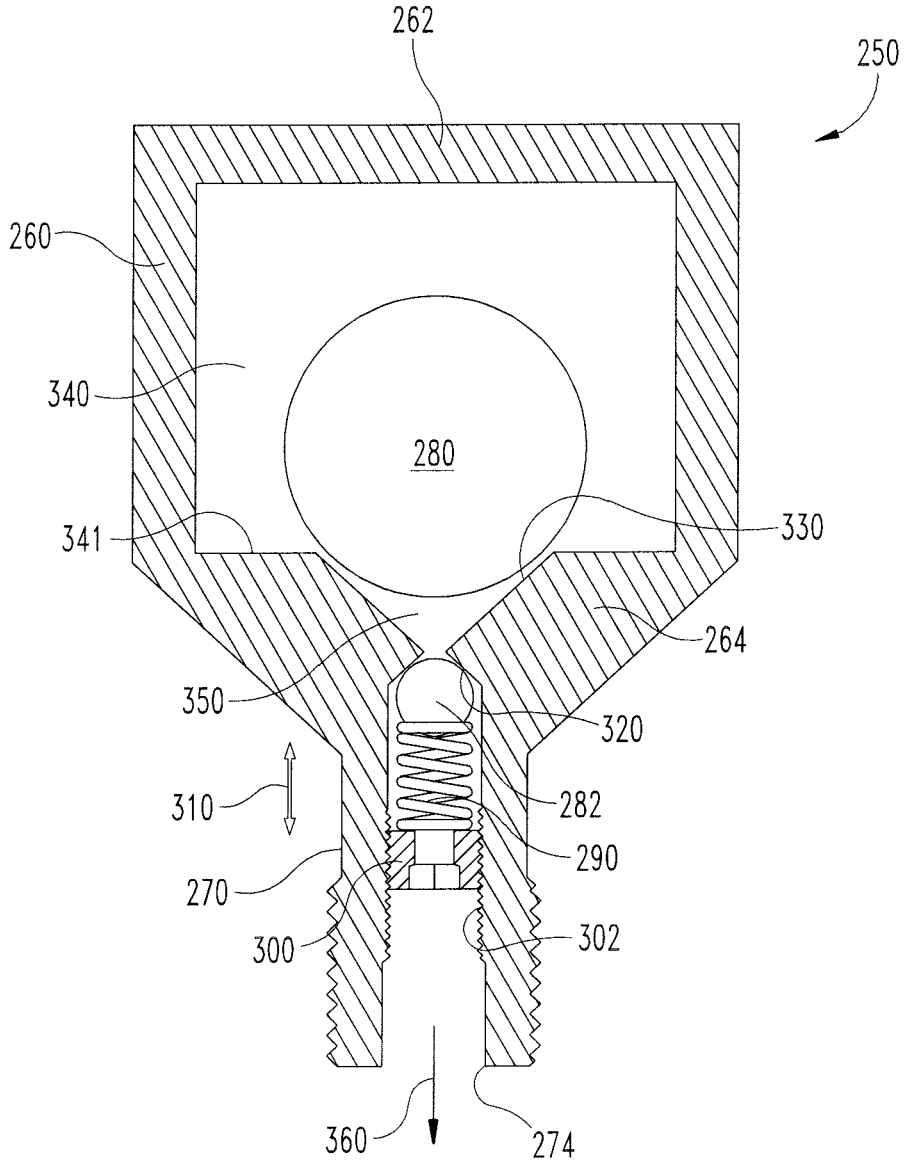
FIG. 6 is side cross sectional view partially cut-away of the float drain module of FIG. 4 with an integrated check valve.

Referring now to FIG. 6, a cross-sectional view of the float drain module 250 is illustrated. The float drain module 250 includes a check valve 282 that operates within the drain conduit 270. A resilient member 290 such as a coil spring or the like is engageable with the check valve 282 to urge the check valve toward a closed position. A threaded retaining plug 300 can be threadingly engageable with a threaded interface 302 formed internal to the drain conduit 270 such that the threaded retaining plug 300 can be positioned to provide a desired pre-load on the resilient member 290 to force the check valve 282 to a normally seated position. In some forms, the resilient member 290 may not directly contact the check valve 282 or the retaining plug 300 as intermediate components can be arranged as would be known to one skilled in the art. The check valve 282 is movable between open and closed positions along a path defined by double arrow 310. A check valve seat 320 can be formed on one side of the lower rim 264 to provide a fluid tight seal between the float drain housing 260 and the check valve 282 when the check valve 282 is in a closed position. The check valve seat 320 can be complementary in shape to a portion of the check valve 282 to form a seal along a contact path there between.

A float valve seat 330 can be formed on the opposing side of the lower rim 264 such that the float valve 280 can engage therewith and form a fluid tight seal there between. When the float valve 280 is engaged with the float valve seat 330 a fluid tight seal is formed between the float valve 280 and the float drain housing 260 to restrict fluid from passing through to the check valve 282. The float valve seat 330 can be complementary in shape to a portion of the float valve 280 to form a seal along a contact path there between.

A first volume 340 is defined within the float drain housing 260 above a first side 341 of the lower rim 264. A second volume 350 is defined between the float valve 280 and the check valve 282 below the first side 341 of the lower rim 264. It should be noted that in some embodiments the second volume 350 can be similar in size or greater than the first volume 340. In alternate embodiments the second volume 350 can be smaller than the first volume 340 and yet other embodiments the second volume 350 is substantially eliminated such that there is no space between the float valve 280 and the check valve 282 when each are seated in a closed position. When the float valve 280 is open, liquid fluid can drain from the first volume 340 to the second volume 350 above the check valve 282. When the check valve 282 opens under a force caused by a hydraulic head, the liquid fluid can pass the check valve 282 and flow through the resilient member 290 and the retaining plug 300 and then flow out of the liquid outlet 274 of the float drain module 250 illustrated by arrow 360. While a mechanical check valve is shown, in the illustrated embodiment, it should be noted that an electromechanical check valve may also be used in some forms.

Material selection for components within this system can include, but are not limited to metals, plastics, ceramics, composites and combinations thereof. The buoyancy of the float valve is a function of the mass and the shape of the float valve as is known to those skilled in the art. Similarly the check valve operates as a function of the density of the liquid, gas pressure, spring force of the resilient member, mass and the shape of the check valve.

In operation the compressor system is configured to provide compressed working fluid such as air at a desired temperature and pressure to external systems. The compressor system can be used in any industrial application including, but not limited to automobile manufacturing, textile manufacturing, process industries, refineries, power plants, mining, material handling, etc. The controller permits user input to define parameters such as pressure, temperature and mass flow rate of one or more fluids. The controller can send command signals to the motor to rotate at a desired operating speed in order to drive the one or more compressors and control various valve members to control airflow rate, coolant flow rate and/or lubrication flow rates.

In the illustrative example, the compressor system 10 includes a three-stage centrifugal compressor system, however, the float drain system of the present application can operate with other types of compressors and/or with more or less stages of compressors. One or more intercoolers 100 can be fluidly coupled to each compressor stage such that after air is compressed through a compression stage the air can be transported through an intercooler to be cooled to a desired temperature via fluid to fluid heat transfer mechanisms as is common in tube type heat exchangers or other similar types. The cooling of hot high pressure fluid having air and water vapor constituencies can cause the water vapor to condense and form liquid water that may be removed from the system as provided herein. This process can be repeated until the working fluid is compressed to a final desired pressure and then subsequently routed to a final stage intercooler to bring the temperature of the final discharged air pressure to the desired temperature for delivery to a final end load or subsystem.

The float drain module 250 is operable to remove the condensed liquids including water from the compressed working fluid with minimal or no loss of compressed air. The float valve 280 will engage or contact with the float seat 330 due to gravitational force acting on the float valve 280. Any liquid that is condensed and drains into the first volume 340 will be restricted from draining out of the float drain housing until the liquid reaches a pre-defined height or level such that the buoyant force of the liquid will cause the float valve 282 rise off of the float seat 330 above the first side 341 of the lower rim 264. When the float valve 280 rises, liquid can flow from the first volume 340 to the second volume 350 and contact the check valve 282. When the hydraulic head as defined by the weight of the liquid above the check valve 282 reaches or surpasses the pre-load force of the resilient member 290, the check valve 282 will lower through the drain conduit 270 along the path defined by double arrow 310. After the check valve 282 is forced off of the check valve seat 320 the liquid that is in the first volume 340 and second volume 350 will flow past the check valve 282, down through the drain conduit 270 and out of the float drain liquid outlet 274. When the liquid level in the first volume 340 lowers to the point wherein the buoyant force of the liquid no longer supports the weight of the float drain valve 280, the float drain valve 280 will once again seat due to gravitational force and contact the float valve seat 330 to seal any remaining liquid in the first volume 340. After the float valve 280 closes the hydraulic head or force of the weight of the liquid above the check valve 282 will fall below the spring force of the resilient member 290 causing the check valve 282 to close against the check valve seat 320. Furthermore, in compressor systems with multiple stages of compressors, the check valve 282 also operates to prevent backflow into any of the compressor stages that are connected to a common condensate removal conduit. In this manner liquid can be drained from the moisture separator housing 208 with minimal or no loss of compressed air or other gaseous working fluid.

In one aspect, the present disclosure includes a compressor system comprising: at least one fluid compressor for compressing a working fluid; at least one heat exchanger for removing heat from compressed working fluid; at least one moisture separator for separating condensed liquid from the compressed working fluid; at least one float drain module housed within the moisture separator for receiving the condensed liquid; a float valve housed within the float drain module being movable between open and closed positions; and a check valve housed within the float drain module being movable between open and closed positions, wherein the check valve is positioned to be in fluid communication with the condensed liquid downstream of the float valve.

In refining aspects, the present disclosure includes a compressor system wherein the float drain module includes a float drain housing having an upper rim and a lower rim for containing the float valve; wherein the float valve contacts a portion of the lower rim of the float drain housing in the closed position; wherein the float valve is movable to an open position when liquid rises to a predetermined level in the float drain housing; wherein the float valve is spherical in shape; wherein the compressor system is further comprised of a resilient member engaged with the check valve; wherein the resilient member urges the check valve to the closed position; a retaining plug threadingly engageable with the float drain module and constructed to engage the resilient member to set a preload force to seat the check valve; wherein the check valve is movable to the open position when a hydraulic head of the condensed liquid overcomes a preload force of the resilient member; wherein liquid is ejected from the moisture separator when the check valve is moved from the closed position to the open position; wherein the check valve is closed prior to ejecting gaseous fluid from the moisture separator.

In another aspect, the present disclosure includes a liquid separator comprising: a housing having a fluid inlet, a fluid outlet and a liquid outlet, the housing configured to receive a working compressed fluid and separate a condensed liquid from a compressed gaseous fluid; a float drain module operably coupled with the liquid outlet of the housing; a float valve operably positioned within the float drain module being movable between open and closed positions; a check valve positioned within the float drain module downstream of the float valve, the check valve being movable between open and closed positions; wherein the float valve is opened under a buoyancy force defined by a predetermined height of condensed liquid within the housing; and wherein the check valve is opened after the float valve is opened and a hydraulic head of the condensed liquid reaches a predefined level.

In refining aspects, the present disclosure includes a liquid separator wherein the check valve is structured to release liquid from the housing in the open position; wherein float valve is configured to close after passing at least a portion of the liquid therethrough and prior to passing gaseous fluid therethrough; wherein the float drain module includes a float drain housing defined by a plurality of support beams intermittently positioned around an outer perimeter and extending between an upper rim and a lower rim, wherein the lower rim includes first and second opposing sides; wherein the lower rim includes a float valve seat defined by the first side; a check valve seat defined by the second side thereof; wherein the float drain housing further comprises: a first volume in fluid communication with the float valve defined on the first side of the lower rim; and a second volume defined on the second side of the lower rim positioned between the float valve and the check valve; wherein the float drain housing includes: a plurality of openings formed around the perimeter and through the upper rim to permit liquid to enter into the first volume; wherein the second volume is configured to fill with liquid when the float valve is opened; wherein the check valve is configured to open after the float valve is opened and the second volume fills with liquid; wherein the float valve seat and check valve seat include a complementary shape to that of the float valve and check valve respectively to provide a fluid tight seal at each corresponding interface; wherein the float valve and check valve are each spherical in shape; wherein the liquid separator further comprising: a resilient member engageable with the check valve; a retaining plug threadably engageable with the float drain module and operable to set a preload between the resilient member and the check valve.

In another aspect, the present disclosure includes a method comprising: compressing a fluid to a predefined pressure; cooling the compressed fluid; flowing the compressed fluid into a liquid separator housing; condensing liquid from the cooled compressed fluid; at least partially filling a first volume with the condensed liquid, wherein the first volume is located in a float drain housing positioned within the liquid separator housing; lifting a float valve rom a valve seat formed on the float drain housing in response to a liquid level rising to a predetermined level; flowing liquid into a second volume upon lifting of the float valve; opening a check valve in response to a hydraulic head of a predetermined amount of liquid being in fluid communication with the second volume; and ejecting liquid from the liquid separator housing when the check valve is open.

In refining aspects, the present disclosure includes a method further comprising: closing the float valve before gaseous fluid passes through the second volume; and closing the check valve before gaseous fluid is ejected from the liquid separator housing.

While the application has been illustrated and described in detail in the drawings and foregoing description, the same is to be considered as illustrative and not restrictive in character, it being understood that only the preferred embodiments have been shown and described and that all changes and modifications that come within the spirit of the applications are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the application, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A compressor system comprising:

at least one fluid compressor for compressing a working fluid;

at least one heat exchanger for removing heat from compressed working fluid;

at least one moisture separator for separating condensed liquid from the compressed working fluid;

at least one float drain module connected to a bottom portion of the moisture separator for receiving the condensed liquid;

a float valve housed within the float drain module being movable between open and closed positions;

wherein the float drain module includes a float drain housing having an upper rim and a lower rim and the float valve is freely movable therebetween;

an inlet aperture formed in the upper rim to receive the condensed liquid and an outlet aperture formed in the lower rim to discharge the condense liquid when the float valve is in the open position;

wherein the float valve contacts a portion of the lower rim of the float drain housing in the closed position; and a check valve housed within the float drain module being movable between open and closed positions, wherein the check valve is positioned to be in fluid communication with the condensed liquid downstream of the float valve.

2. The compressor system of claim 1, wherein the float valve is movable to an open position when liquid rises to a predetermined level in the float drain housing.

3. The compressor system of claim 1, wherein the float valve is spherical in shape.

4. The compressor system of claim 1, further comprising:

a resilient member engaged with the check valve.

5. The compressor system of claim 4, wherein the resilient member urges the check valve to the closed position.

6. The compressor system of claim 4, further comprising:

a retaining plug threadingly engageable with the float drain module and constructed to engage the resilient member to set a preload force to seat the check valve.

7. The compressor system of claim 4, wherein check valve is movable to the open position when a hydraulic head of the condensed liquid overcomes a preload force of the resilient member.

8. The compressor system of claim 1, wherein liquid is ejected from the moisture separator when the check valve is moved from the closed position to the open position.

9. The compressor system of claim 1, wherein the check valve is closed prior to ejecting gaseous fluid from the moisture separator.

10. A liquid separator comprising:

a housing having a fluid inlet, a fluid outlet and a liquid outlet, the housing configured to receive a working compressed fluid and separate a condensed liquid from a compressed gaseous fluid;

a float drain module operably coupled with the liquid outlet of the housing;

wherein the float drain module includes a float drain housing defined by a plurality of support beams intermittently positioned around an outer perimeter and extending between an upper rim and a lower rim;

wherein the upper rim includes an aperture formed therethrough to permit condensed liquid ingress into the float drain housing;

a float valve operably positioned within the float drain module being movable between open and closed positions;

a check valve positioned within the float drain module downstream of the float valve, the check valve being movable between open and closed positions;

wherein the float valve is opened under a buoyancy force defined by a predetermined height of condensed liquid within the housing; and wherein the check valve is opened after the float valve is opened and a hydraulic head of the condensed liquid reaches a predefined level.

11. The liquid separator of claim 10, wherein the check valve is structured to release liquid from the housing in the open position.

12. The liquid separator of claim 10, wherein float valve is configured to close after passing at least a portion of the liquid therethrough and prior to passing gaseous fluid therethrough.

13. The liquid separator of claim 10, wherein the lower rim includes first and second opposing sides.

14. The liquid separator of claim 13, wherein the lower rim includes:

a float valve seat defined by the first side; and a check valve seat defined by the second side thereof.

15. The liquid separator of claim 13, wherein the float drain housing further comprises:

a first volume in fluid communication with the float valve defined proximate the first side of the lower rim; and a second volume defined proximate the second side of the lower rim positioned between the float valve and the check valve.

16. The liquid separator of claim 15, wherein the float drain housing includes a plurality of openings formed around the perimeter to permit liquid to enter into the first volume.

17. The liquid separator of claim 15, wherein the second volume is configured to fill with liquid when the float valve is opened.

18. The liquid separator of claim 15, wherein the check valve is configured to open after the float valve is opened and the second volume fills with liquid.

19. The liquid separator of claim 14, wherein the float valve seat and check valve seat include a complementary shape to that of the float valve and check valve respectively to provide a fluid tight seal at each corresponding interface.

20. The liquid separator of claim 10, wherein the float valve and check valve are each spherical in shape.

21. The liquid separator of claim 10 further comprising:

a resilient member engageable with the check valve.

22. The liquid separator of claim 21 further comprising:

a retaining plug threadably engageable with the float drain module and operable to set a preload between the resilient member and the check valve.

23. A method comprising:

compressing a fluid to a predefined pressure;

cooling the compressed fluid;

flowing the compressed fluid into a liquid separator housing;

condensing liquid from the cooled compressed fluid;

at least partially filling a first volume with the condensed liquid, wherein the first volume is located in a float drain housing between an upper rim and a lower rim positioned within the liquid separator housing, wherein the upper rim includes an inlet aperture formed therethrough and the lower rim includes an outlet aperture formed therethrough;

lifting a float valve from a valve seat formed on the lower rim of the float drain housing in response to a liquid level rising to a predetermined level;

flowing liquid into a second volume located below the first volume upon lifting of the float valve;

opening a check valve in response to a hydraulic head of a predetermined amount of liquid being in fluid communication with the second volume; and ejecting liquid from the liquid separator housing when the check valve is open.

24. The method of claim 23 further comprising:

closing the float valve before gaseous fluid passes through the second volume.

25. The method of claim 23 further comprising:

closing the check valve before gaseous fluid is ejected from the liquid separator housing.

* * * * *